US005259890A

United States Patent [19]

Goff

[11] Patent Number: 5,259,890

[45] Date of Patent: Nov. 9, 1993

[54] WASHING DEVICE FOR MACHINE PARTS AND METHOD OF USING THE DEVICE

[75] Inventor: James R. Goff, Seminole, Okla.

[73] Assignee: Goff Division, George Fischer Foundry Systems, Inc., Seminole, Okla.

[21] Appl. No.: 855,467

[22] Filed: Mar. 23, 1992

Related U.S. Application Data

[63] Continuation of Ser. No. 688,719, Apr. 23, 1991, abandoned, which is a continuation of Ser. No. 406,185, Sep. 13, 1989, abandoned, which is a continuation of Ser. No. 73,182, Jul. 14, 1987, abandoned.

[51] Int. Cl.[5] ..... B08B 3/02

[52] U.S. Cl. ..... 134/32; 134/153; 134/181; 134/200

[58] Field of Search ..... 239/214, 222, 222.11, 239/223, 224; 134/79, 140, 142, 143, 144, 147, 153, 158, 174, 200, 24, 172, 32, 173, 175, 176, 177, 178, 180, 181, 167 R, 129, 44

[56] References Cited

U.S. PATENT DOCUMENTS

| | | | |
|---|---|---|---|
| 1,030,887 | 7/1912 | Hauk, Jr. | 134/143 X |
| 1,469,625 | 10/1923 | Dodge | 134/200 |
| 1,520,110 | 12/1924 | Bakeslee | 134/143 X |
| 1,999,946 | 4/1935 | Rogers | 134/174 |
| 2,078,699 | 4/1937 | Taylor et al. | 134/140 X |
| 2,147,247 | 2/1939 | Doty et al. | 134/167 R X |
| 2,493,215 | 1/1950 | Barnes . | |
| 2,515,665 | 7/1950 | Pieper | 239/223 |
| 2,673,761 | 3/1954 | Karlstrom | 134/184 |
| 2,815,246 | 12/1957 | Nyrop | 239/223 |
| 2,850,322 | 9/1958 | Ingram | 239/222 |
| 3,094,997 | 6/1963 | Nolte et al. | 134/153 X |
| 3,220,653 | 11/1965 | Waldrum | 239/224 X |
| 4,356,972 | 11/1982 | Vikre | 239/222.11 |
| 4,420,003 | 12/1983 | Lee et al. | 134/153 X |
| 4,723,377 | 2/1988 | Watts | 134/153 |

FOREIGN PATENT DOCUMENTS

| | | | |
|---|---|---|---|
| 759830 | 2/1934 | France | 134/167 R |

*Primary Examiner*—Frankie L. Stinson

*Attorney, Agent, or Firm*—Finnegan, Henderson, Farabow, Garrett & Dunner

[57] ABSTRACT

A washing machine for nondestructively cleaning machine parts comprises an enclosure and a water wheel for projecting a wash liquid against an object to be treated. The water wheel rotates at high speed. Washing liquid is fed into a central opening in the water wheel, and the liquid is projected at high velocity against the object to be cleaned. The liquid is projected in a pattern comprising a plurality of spaced-apart, geometrically similar, arcuate, dense zones of wash liquid. A pulsed cleaning effect is obtained. The device is especially useful for cleaning worn automotive and truck brake shoes prior to reconditioning the brake shoes.

24 Claims, 7 Drawing Sheets

(FLOW PASSAGES B&E)

(FLOW PASSAGES A&D)

(FLOW PASSAGES C&F)

WASHING DEVICE FOR MACHINE PARTS AND METHOD OF USING THE DEVICE

This application is a continuation, of application Ser. No. 07/688,719, filed Apr. 23, 1991 now abandoned, which is a continuation of application Ser. No. 406,185, filed Sep. 13, 1989, now abandoned, which is a continuation of application Ser. No. 073,182, filed Jul. 14, 1987 now abandoned.

BACKGROUND OF THE INVENTION

This invention relates to a washing machine for scrubbing and cleaning objects with a washing fluid and to a method of using the machine. The method and apparatus are useful for cleaning worn machine parts prior to reconditioning the parts.

In many types of mechanical devices and machines, parts of the devices are exposed to dirt, grease, and other solid and liquid contaminants that impede the performance of the device. In other cases, parts of the devices deteriorate through normal wear, and while they can be removed from the machine, reconditioned and reinstalled, the parts may be so contaminated with dirt and grease that reconditioning is impractical. It is necessary to thoroughly clean the dirty or worn parts when these conditions are encountered.

Washing the parts with water is a desirable cleaning method, but this method is not acceptable when the contaminants are not readily soluble in water. The use of organic solvents can greatly aid cleaning, but the cost is usually prohibitive. Furthermore, solvent vapors must generally be incinerated or recovered in order to meet State and Federal standards for the discharge of volatile organic solvents. In addition, the spent solvent must either be recovered for reuse or discarded in such a way as to comply with current waste disposal laws. In any event, the use of volatile organic solvents is costly and poses environmental risks.

The need to recondition vehicle parts, such as automotive and truck brake shoes, presents a significant challenge. A brake shoe is a shaped metal part having a brake pad, such as an asbestos pad, riveted to the metal part. The shaped metal part forming the major portion of the brake shoe is costly to manufacture. In addition, brake shoes come in a variety of shapes and sizes and it is impractical to maintain an inventory of all of the different types. For these reasons, it is frequently advantageous to recondition the brake shoe by removing and replacing the brake pad. Commercial shops exist throughout the nation to perform this important service for truckers. Time is of the essence, since a vehicle is removed from service while the brake shoes are being reconditioned.

Worn brake shoes are usually covered with a heavy encrustation of dirt and other solid matter. In addition, the worn shoes are frequently contaminated with grease, oil, and sludge. These contaminants cover the rivets holding the brake pad on the brake shoe and also prevent easy removal of the pad by acting as a bonding medium along the edges of the brake pad and the surface of the brake shoe. Thus, before the brake pad can be removed from the worn brake shoe, the dirt, grease, and other contaminants must be removed. Soaking the worn brake shoe in water is not sufficient, since the contaminants are not readily soluble in water. Manual scraping of the parts is not practical for economic reasons; not only is manual labor costly, but manual cleaning is slow, which can extend the time required to return the vehicle to service.

Thus, there exists a need in the art for an apparatus and a method for cleaning mechanical parts covered with solid dirt, grease, oil and other contaminants. The method and apparatus should be suitable for removing water soluble as well as water insoluble contaminants from the parts. The apparatus and method should also be suitable for removing heavy encrustations of solid matter, which are not practically removed by manual scraping. Since the parts will be reconditioned and reused, it is important that the apparatus and method make it possible to non-destructively clean the parts. The apparatus and method should be relatively simple, be of low cost, and require relatively low maintenance during operation. It would be highly advantageous if the cleaning time was relatively short so that the vehicle or machine from which the parts were removed could be quickly restored to service. The method and apparatus should require relatively small amounts of cleaning fluid and should be capable of cleaning parts with water as the principal cleaning fluid. If organic solvents are used, the amounts required should be relatively small. In addition, the cleaning fluid should be reusable.

SUMMARY OF THE INVENTION

This invention aids in fulfilling these needs in the art by providing a washing machine for non-destructively cleaning an object, such as an automotive or truck brake shoe contaminated with encrusted solid matter, grease, oil and other contaminants. The machine comprises an enclosure means and opening means in the enclosure for introducing an object to be cleaned into the enclosure and for removing the object from the enclosure. The machine includes means for projecting a wash liquid into the enclosure. The projecting means comprises a rotatable wheel means having an outer periphery and a central opening in the wheel. Means are provided for rotating the wheel at high speed. Means for feeding wash liquid at high volume and low pressure into the central opening of the wheel are also provided.

The rotatable wheel has a plurality of flow passage means for delivering the wash liquid from the central opening to the periphery of the wheel. In the central opening, means are provided for diverting flow of the wash liquid from the central opening into each of the flow passage means during a portion of each revolution of the wheel. The wash liquid is discharged from the periphery of the wheel in a pattern comprising a plurality of spaced-apart, geometrically similar, arcuate, dense zones of the liquid. The machine further comprises means for supporting the object to be cleaned in a position to receive the liquid discharged from the wheel before the dense zones of liquid dissipate. The machine includes means for draining spent wash liquid from the enclosure.

This invention also provides a washing system for nondestructively cleaning an object comprising the water wheel previously described and means for supporting the object to be cleaned in a position to receive the liquid discharged from the wheel before the dense zones of liquid dissipate.

In addition, this invention provides a method for non-destructively cleaning an object. The method comprises inserting an object contaminated with foreign matter into an enclosure, and projecting a wash liquid into the enclosure and onto the object for a time sufficient to dislodge the foreign matter and to wash the foreign matter from the object. The wash liquid is discharged from the periphery of a wheel rotating at high speed, and the wash liquid is in a pattern comprising a plurality of spaced apart, geometrically similar, arcuate, dense zones of the liquid.

BRIEF DESCRIPTION OF THE DRAWINGS

This invention will be more fully understood by reference to the drawings in which.

DETAILED DESCRIPTION

The washing machine of this invention is useful for the non-destructive cleaning of durable objects, such as machine parts and similar objects. The objects can be contaminated with any type of organic or inorganic materials. Contaminants can be solid or liquid, and are usually comprised of dirt, grease, and oil. The machine is particularly effective for cleaning worn brake shoes prior to reconditioning the shoes for reuse. Worn brake shoes are usually contaminated with grease and road sludge. A wash liquid is projected inside the machine with sufficient momentum to clean the objects. The magnitude of the force can be detected and measured by hand without harm to the individual. It is possible to clean objects without material alteration of the natural surface characteristics of the object.

Figure 1:
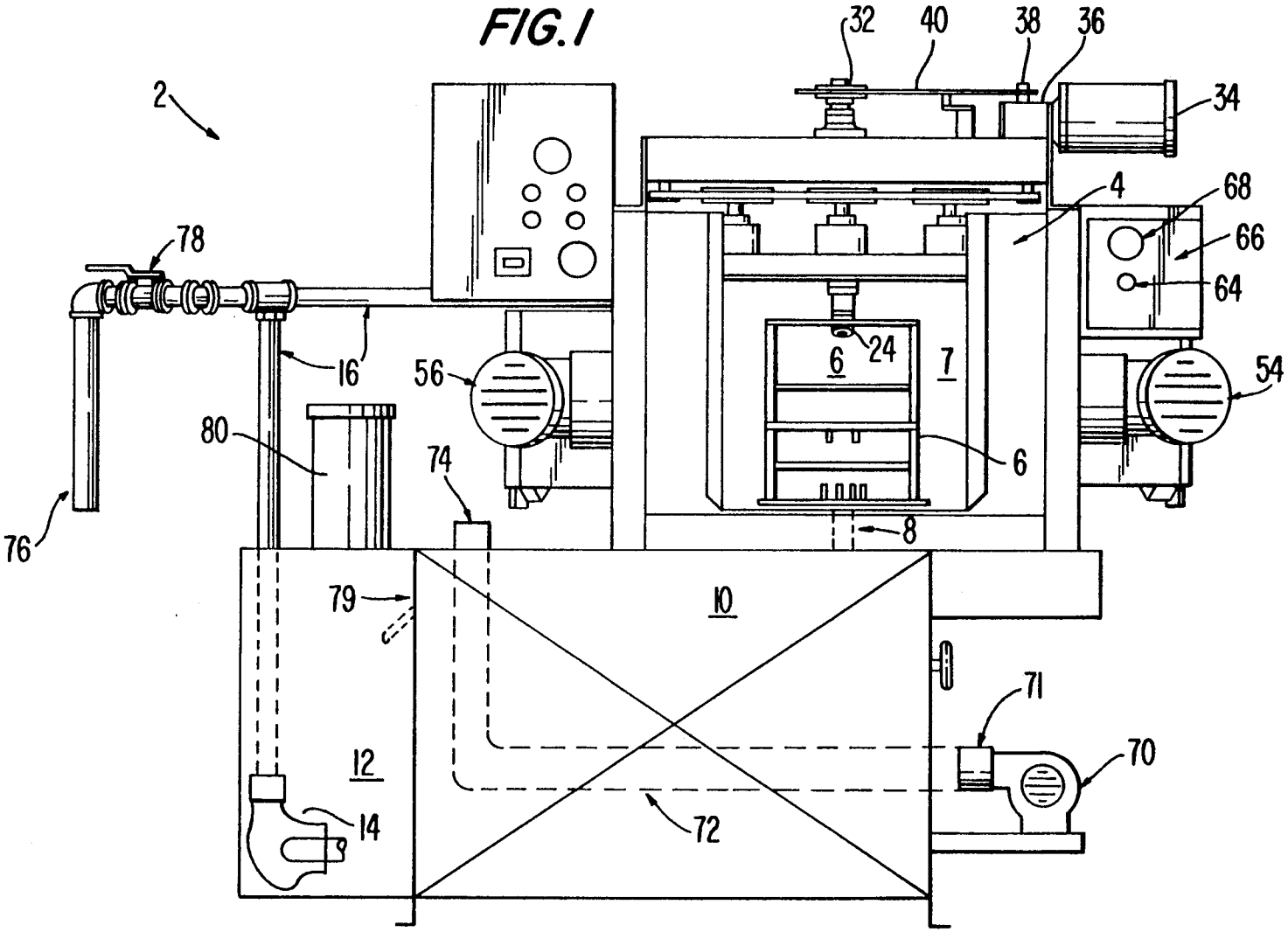
FIG. 1 is a front view of one embodiment of a washing machine of the invention.

FIG. 1 shows an elevation view of one embodiment of a washing machine that is particularly useful for cleaning worn brake shoes that are encrusted with solid dirt, grease, oil, and other contaminants normally found on such objects. Referring to FIG. 1, the washing machine of the invention is generally designated as 2. An enclosure 4 contains a workpiece chamber 6. An opening 7 in the enclosure 4 makes it possible to insert worn brake shoes into the workpiece chamber 6 and to remove the brake shoes from the chamber after they are cleaned.

A wash liquid, such as water, is projected into the workpiece chamber 6, and spent wash liquid flows from the workpiece chamber 6 through a drain opening 8 into a removable basket (not shown) and into main water tank 10. Adjacent to the main water tank 10 is a secondary water tank 12 containing a submerged pump 14. Water underflowing from the main water tank 10 is drawn into the secondary water tank 12 by pump 14, which discharges the water through a water line 16 to a water wheel that projects the water into the rear of enclosure 4.

Figure 2:
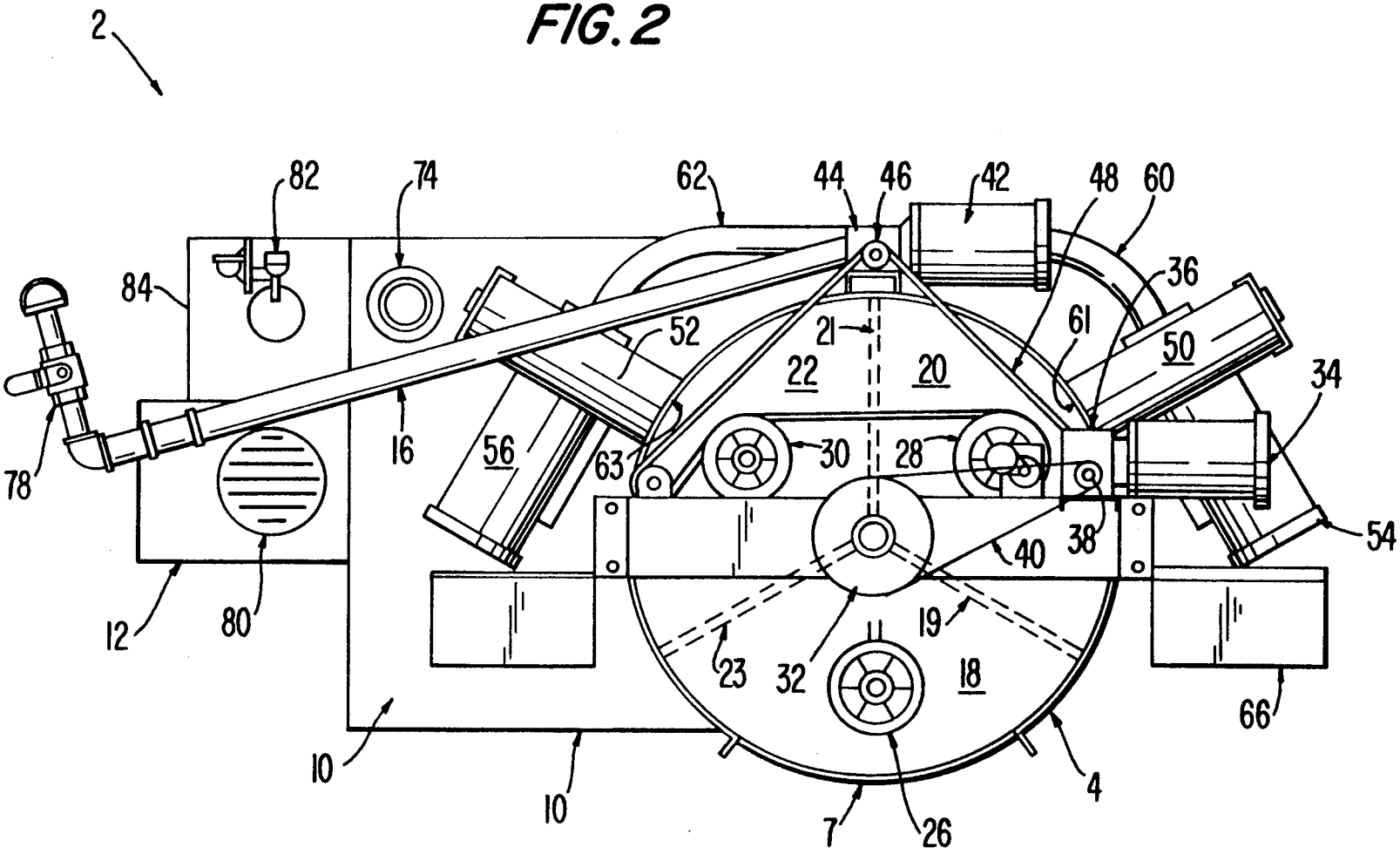
FIG. 2 is a top view of the washing machine of FIG. 1.

FIG. 2 shows a plan view of the washing machine of FIG. 1. It will be seen that the workpiece chamber 6 is divided into three separate compartments 18, 20, and 22 by partitions 19, 21, and 23. The compartments 18, 20, and 22 are isolated from each other. The compartment 18 is provided with a hanger 24 (see FIG. 1) for suspending a worn brake shoe inside the compartment. The hanger 24 is connected to a rotatable sheave 26 outside the enclosure. A worn brake shoe is inserted through opening 7 into the compartment 18 of washing chamber 6 and suspended from hanger 24. Compartment 20 is provided with a similar hanger that is rotatable by sheave 28, and compartment 22 is provided with a similar hanger rotatable by sheave 30.

The workpiece chamber 6 is suspended from another rotatable sheave 32. Sheave 32 is rotated by a drive belt 40 connected to a sheave 38 on a gear box 36 driven by a motor 34. The motor 34 is provided with an ON-OFF control circuit by means of which the motor is activated for a period of time sufficient to rotate the workpiece chamber 6 and the accompanying compartments 18, 20, and 22 through an arc of 120°. The motor 34 is then deenergized. Thus, the chambers 18, 20, and 22, move past the opening 7 in sequence.

The motor 34 is deenergized for a period of time sufficient to permit an operator to position a worn brake shoe in the compartment (18, 20, or 22) that is aligned with the opening 7. The time period during which the motor 34 is deenergized can be automatically controlled, but preferrably the time period is determined by the operator. For example, the operator can energize motor 34 by pressing a button 64 on an electrical switch in control panel 66. The control panel can also be provided with an emergency stop switch 68 for the safety of the operator.

The sheaves 26, 28, and 30 for rotating the brake shoes in compartments 18, 20, and 22, respectively, are driven by a flexible, deformable drive belt 48 connected to a sheave 46 on a gear box 44 driven by a motor 42. It will be apparent from FIG. 2 that only two of the sheaves rotate when the motor 42 is energized. As the workpiece chamber 6 rotates in a clockwise direction, the sheave 30 disengages from the drive belt 48, and the sheave 28 pushes the drive belt out of the path of motion of sheave 28. Sheave 26 approaches the position previously occupied by sheave 28. When the cycle has been completed, each of the sheaves has moved through an arc of 120°, two of the sheaves are rotatable when motor 42 is activated, and the third sheave is stationary over the opening 7 in workpiece chamber 6. The sheave in the compartment aligned with opening 7 does not rotate because the operator must have unimpeded access to this compartment to insert and remove worn brake shoes.

Referring to FIG. 2, a water wheel cabinet 50 containing a water wheel is installed on one side of the rear portion of the enclosure 4. A similar cabinet 52 containing a water wheel is installed on the other side of the rear portion of enclosure 4. The water wheel in cabinet 50 is driven by a motor 54 and the water wheel in cabinet 52 is driven by a motor 56. Water from pipeline 16 passes through a hose 60 into the central portion of the water wheel in cabinet 50. Water from pipeline 16 also passes through a hose 62 into the central portion of the water wheel in cabinet 52. The enclosure 4 is provided with openings 61 and 63 through which the washing fluid is projected by the water wheels in water wheel cabinets 50 and 52, respectively.

It will be apparent from FIGS. 1 and 2 that an operator can load, activate, and unload the washing machine with minimal effort. The operator inserts a worn, dirty brake shoe through the opening 7 in enclosure 4 and hangs the brake shoe from the hanger 24 in compartment 18. The operator presses the switch 64 to energize motor 34 and thereby rotate the workpiece chamber through an arc of 120°. This results in the brake shoe in compartment 18 being positioned in front of the water wheel in cabinet 50. Motor 54 is energized to rotate the water wheel in cabinet 50 to project the water flowing through hose 60 against the worn brake shoe in compartment 18. Meanwhile, the operator loads another worn, dirty brake shoe into compartment 22, which is now aligned with the opening 7 in enclosure 4. The operator once again presses the switch 64 to activate motor 34 to rotate the workpiece chamber 6 through an arc of 120°. Chamber 18 is then positioned in front of the water wheel in cabinet 52 and chamber 22 is positioned in front of the water wheel in cabinet 50. The brake shoes in the compartments 18 and 22 are then scrubbed. Meanwhile, the operator can load a worn, dirty brake shoe in compartment 20, which is now aligned with the opening 7 in enclosure 4. The operator removes a cleaned brake shoe and inserts a dirty brake shoe in each of the compartments aligned with opening 7 in enclosure 4 and repeats the wash cycle.

In order to facilitate removal of oil, grease, and other foreign matter from the brake shoes, it is desirable to heat the wash fluid in the main water tank 10. A propane gas burner 70, a fire tube 71 and a heat exchanger 72 are provided for this purpose (see FIG. 1). Waste gas from the burner 70 is removed from the system through a vent 74. The heat exchanger 72 can be a hollow pipe submerged in the water in the main water tank 10. The heat transfer area of the pipe can be increased by providing two or more 180° bends in the pipe so that the pipe traverses the inside of water tank 10 two or more times.

When the water is heated, some water loss occurs through evaporation. The washing machine can be provided with a water line 76 and a valve 78 for controlling the supply of makeup water to the machine.

Spent wash liquid that drains from each of the compartments 18, 20, and 22 carries with it some solid matter that may be relatively large in size. In order to prevent large pieces of material from being recycled to the water wheels, the water flows into a removable basket where large pieces of solid material are collected. The basket can be periodically removed and cleaned. Small pieces of foreign matter (e.g. less than 3/16 inch) can be removed by a finer filter, if necessary, but are usually recycled with the wash liquid to the water wheels by the pump 14.

In order to prevent the washing machine from overflowing with wash liquid, a float and float switch 82 are provided in a water compartment 84 connected to the secondary water tank 12 as shown in FIG. 2. The float switch can be connected by a suitable control circuit to an automatic valve in the makeup water line 76 to control the level of the wash liquid in the machine. The water wheel and its mode of operation will now be described in more detail.

Figure 3:
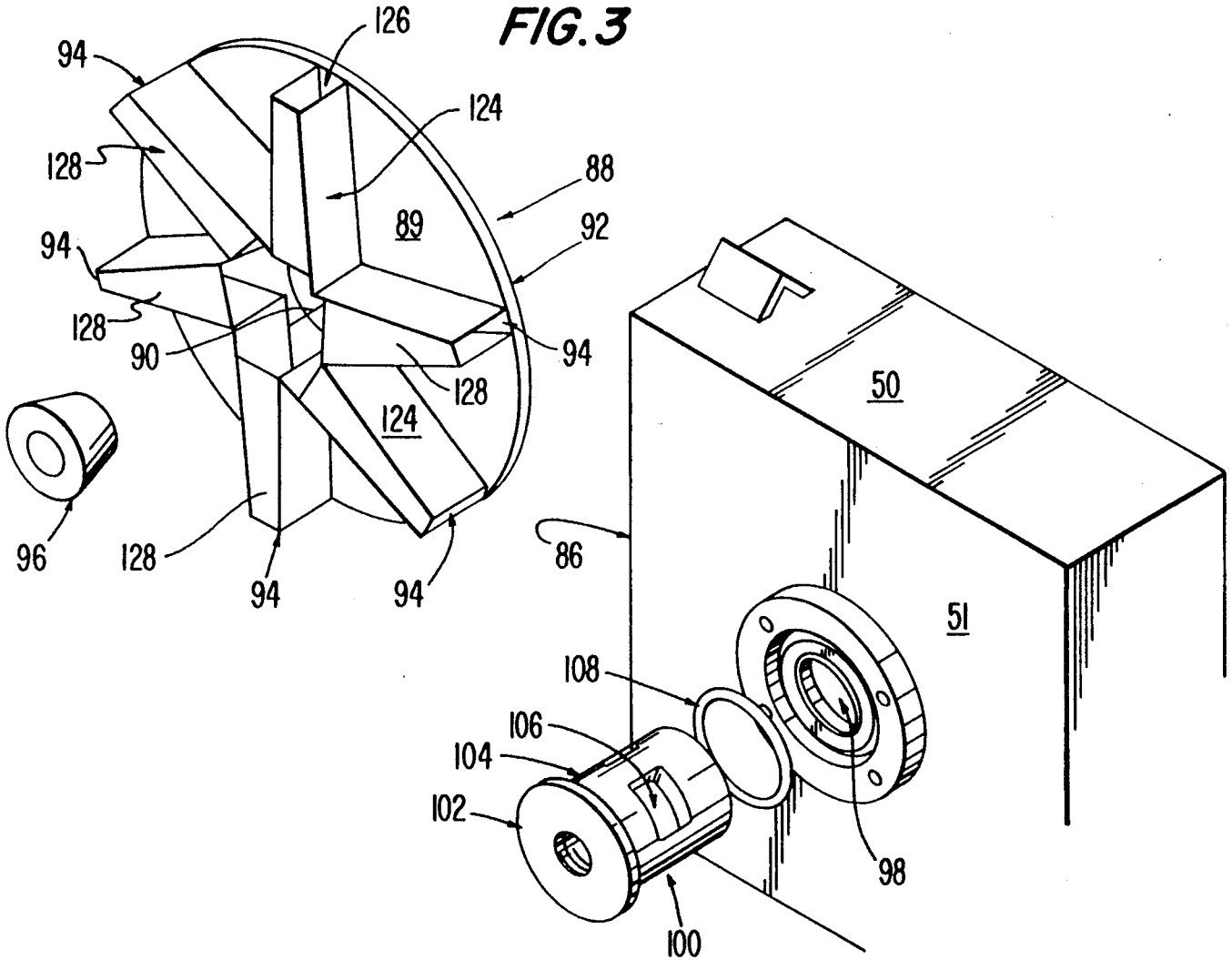
FIG. 3 is an assembly drawing showing a water wheel and water wheel cabinet of the type used in the washing machine of FIG. 1.

Referring to FIG. 3, water wheel cabinet 50 is shown removed from the enclosure 4 in FIG. 2. The cabinet 50 has an opening 86 for inserting water wheel 88 into the cabinet and for projecting the wash liquid out of the cabinet into enclosure 4 when the water wheel is in use. The water wheel 88 comprises a circular plate 89 having a central opening 90 and an outer periphery 92. A plurality of flow passages 94 are spaced around the circumference of the water wheel. A motor shaft adaptor and coupling 96 is inserted in the opening, and the water wheel 88 is then inserted in the cabinet 50.

The water wheel cabinet 50 has an opening 98 centrally located in side 51 of the cabinet 50. A flow diverter 100 for the wash liquid is inserted through the opening 98 in cabinet 50 and into the central opening 90 in the water wheel 88. The flow diverter comprises a base plate 102 fixed to a cylindrical portion 104. The cylindrical portion 104 has an opening 106 therethrough. The flow diverter 100 is passed through a gasket 108 before it is inserted into opening 98 in the cabinet 50.

During operation, the wash liquid is fed through hose 60 into the cylindrical portion 104 of flow diverter 100. The wash liquid passes through the opening 106 in flow diverter 100 and into the central opening 90 of the water wheel 88. The flow diverter 100 remains in a fixed position as the water wheel rotates at high speed. It is thus apparent that the wash liquid does not pass through all of the flow passages 94 at the same time. Rather, the liquid passes only through the passages 94 that are aligned with the opening 106 in flow diverter 100 at any instant in time. This makes it possible to control the direction in which the wash liquid is thrown. For example, when the flow diverter 100 is inserted in the opening 98 in cabinet 50, it should be rotated in a clockwise direction so that the arrow embossed on the base plate 102 is pointing toward the opening 86 in cabinet 50. Water will thus be thrown by the water wheel 88 through the opening 86.

Figure 4:
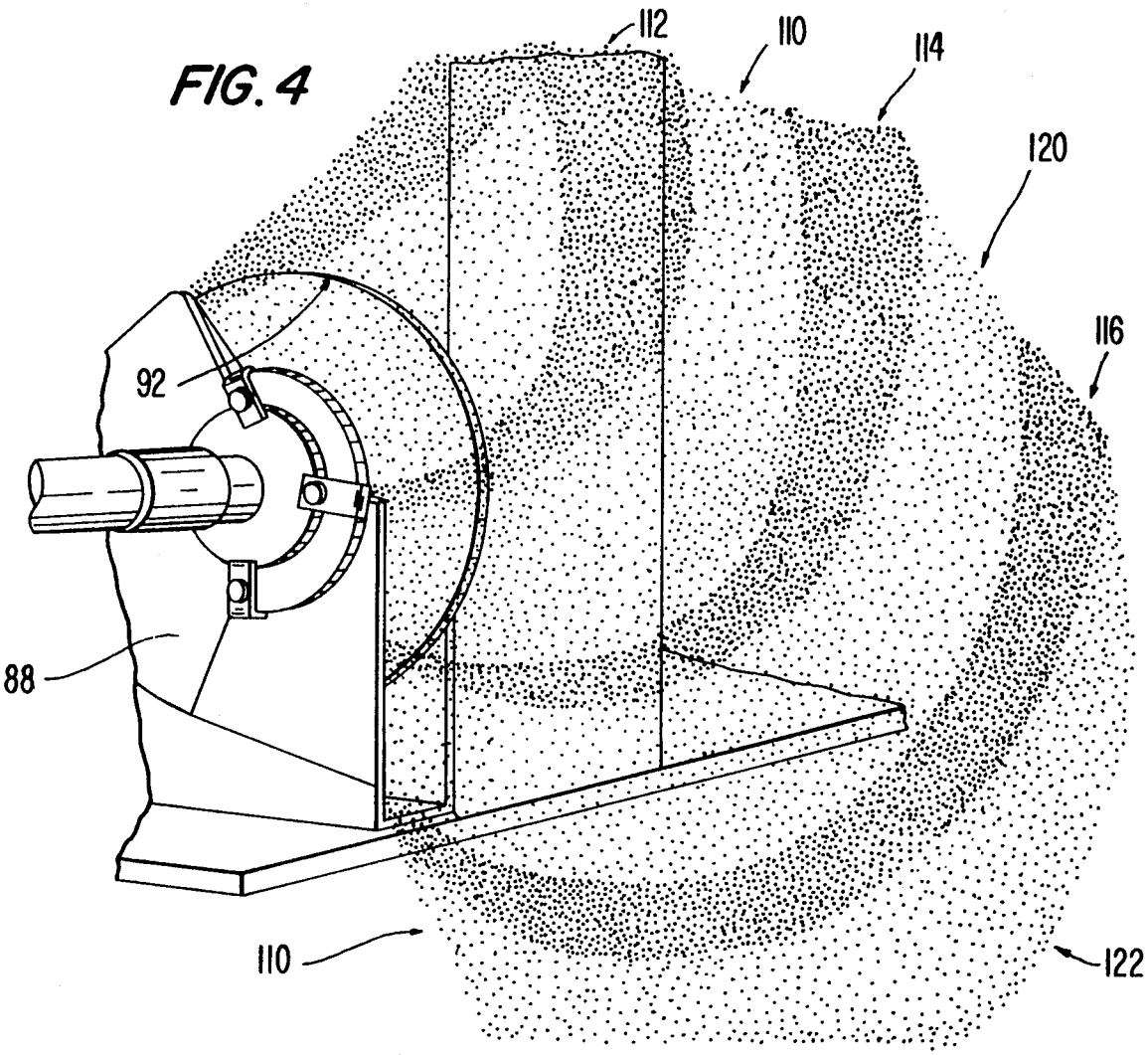
FIG. 4 is a diagram of a pattern produced when the water wheel of FIG. 3 projects a washing liquid.

Referring to FIG. 4, the wash liquid from the water wheel 88 is propelled in a pattern 110 comprised of a dispersion of water in air. The water is the dispersed phase and the air is the continuous phase. The pattern has a heterogenous density; that is, the weight ratio of water to air varies from one location of the pattern to another. It is apparent from FIG. 4 that there are recurring regions in which the ratio of water to air is relatively high. These regions are referred to as dense zones and are designated 112, 114, and 116 in the Figure. The dense zones are separated by diffuse zones 118, 120, and 122 in which the weight ratio of water to air is low, and possibly even near zero. While three dense zones and three diffuse zones are shown in FIG. 4, it will be understood that the pattern 110 can be comprised of a greater or lesser number of such zones. If the pattern depicted in FIG. 4 was extended, the pattern would gradually assume a fan-shaped appearance.

Each of the dense zones 112, 114, and 116 in FIG. 4 has an arcuate shape. The zones are of different size at any instant in time, since the curvilinear distance covered by each of the dense zones increases as the zone moves farther away from the periphery 92 of water wheel 88. Nevertheless, the dense zones are geometrically similar in shape. Each dense zone may be so concentrated that it appears to be a substantially continuous liquid phase with substantially no scattering of liquid particles, if present, in the major portion of the dense phase. The dense phase can contain globules of liquid or agglomerated liquid or very closely spaced water droplets of substantial size.

Water wheel 88 rotates at a very high speed and projects a large mass of liquid. The liquid leaves the periphery of the water wheel at a high velocity. Thus, the dense zone 112 in FIG. 4 possesses very high momentum. When this dense zone impacts on a dirty object, a cleaning and scrubbing effect is obtained. It is possible to remove heavy encrustations of foreign matter that tenaciously adhere to the object while simultaneously removing grease, oil, and similar materials.

Since the dense zones of wash liquid are spaced apart at periodic intervals, a pulse washing effect is produced. The object to be cleaned is impacted with high momentum liquid at recurring time intervals. This aids in dislodging foreign matter and allows the matter to flow away from the object between impulses.

The dense zones 112, 114, and 116 have a relatively small radial dimension close to the periphery 92 of water wheel 88. The radial dimension of each dense zone increases as the zone moves radially away from the periphery 92. This is accompanied by dissipation of the water in the dense zones and a loss of momentum. This will result in a reduction in the scrubbing and cleaning effect produced by the dynamic wash liquid. Thus, it is generally desirable to place the object to be cleaned at a distance from the water wheel that will insure that the required cleaning effect is obtained without damaging the object.

The disperse zones 118, 120, and 122 are characterized by a low weight ratio of water to air, and possibly even a weight ratio near zero. The disperse zones can contain substantial amounts of mist, fog, fine spray, and atomized liquid and thus resemble the spray formed by conventional spray nozzles. The disperse zones have a small radial dimension close to the water wheel 88, which enlarges as the distance from the water wheel increases. The disperse zones are formed while the flow of wash liquid from the central opening 90 through the flow passages 94 is interrupted as the solid vertical walls of the flow passages traverse the opening 106 in the flow diverter 100 (see FIG. 3). The disperse zones have a minimal effect on dislodging material from the object being cleaned. Nevertheless, the disperse zones can produce a rinsing effect on the object between high momentum impulses created by the dense zones in the pattern.

The pattern shown in FIG. 4 is substantially continuous; that is, there is a continuous dispersion of water in air, which varies in density throughout the pattern. It will be understood, however, that the pattern can be discontinuous by providing substantially water-free zones between one or more of the dense zones.

Preferably, there is substantially no atomization of water in the dense zones in the wash liquid pattern. If atomization does occur, the extent of atomization should be sufficiently small so that the scrubbing and cleaning effects produced by the recurring pulses of wash liquid are not adversely affected.

Discharge of the wash liquid from the periphery of the water wheel in a pattern comprising a plurality of spaced apart, geometrically similar, arcuate, dense zones of liquid is a unique and important feature of this invention. The cleaning effect is substantially greater than that heretofore obtained with spray nozzles or continous streams of wash liquid.

The water wheel employed in the apparatus of the invention is a statically and dynamically balanced wheel capable of rotating at high speed. The size of the wheel depends upon economic factors and the cleaning effect required. Generally, the diameter of the water wheel, the rotational speed of the wheel, the flow rate of wash liquid into the central opening in the wheel and the configuration of the flow passages are interdependent.

The diameter of the water wheel affects the rotational speed required to obtain effective cleaning. A larger wheel generally requires a lower rotational speed for a given flow rate of liquid into the central opening of the wheel than a smaller wheel for a comparable cleaning effect. For most applications the water wheel will have a diameter of about 8 inches to about 20 inches, and will preferably be about 14 inches in diameter.

The flow rate of the wash liquid into the central opening of the wheel affects the horsepower requirement for driving the water wheel at the required rotational speed. Generally, the drive motor for the water wheel is sized for a particular flow rate. Thus, increasing the flow rate to the water wheel in a large increment may require an increase in the size of the drive motor. Increasing the horsepower to the water wheel can permit substantial increases in the mass of wash liquid that is projected onto the object to be cleaned with a resulting greater cleaning effect.

The rotational speed of the water wheel is relatively high, and is usually about 900 rpm to about 3500 rpm, and is typically greater than about 1800 rpm for most applications. This insures that high momentum will be imparted to the wash liquid as it leaves the periphery of the water wheel. For example, a water wheel having a diameter of about 8–9 inches can be rotated at about 3600 rpm, and a water wheel having a diameter of about 20 inches can be rotated at about 1800 rpm with a larger motor and a larger opening in the flow diverter. If the rotational speed is too high, the wash liquid will be propelled from the periphery of the wheel in the form of a spray without the formation of adequate dense zones of liquid for cleaning. On the other hand, if the rotational speed is too low, dense zones of wash liquid will be formed, but the wash liquid will not have sufficient momentum for adequate cleaning. The rotational speed of the water wheel also affects the distance between the dense zones of wash liquid; low rotational speeds result in greater distances between dense zones.

Once rotation of the water wheel is commenced and the wheel achieves a constant speed, the wheel is generally operated at this speed during the wash cycle. It will be understood, however, that the wheel can be accelerated and decelerated a multiplicity of times during each wash cycle, although adequate cleaning is usually obtained without such a control requirement.

The pump that feeds the wash liquid to the central opening of the water wheel can be a conventional liquid handling pump. The pump can be of the submerged type or installed above the wash liquid in the water tanks 10 and 12. The pump should be sized to handle the volume of liquid required to insure adequate cleaning of the dirty objects. Of course, the water volume discharged by the pump should be controlled to avoid overloading the motors driving the water wheels in the washing machine. The flow rate of wash liquid discharged by the pump will usually be about 10 gpm to about 120 gpm at 20°C. A centrifugal pump having a capacity of about 100 gpm has been found to be suitable for use in the washing machine depicted in FIGS. 1 and 2.

A low pressure pump is generally satisfactory, since the pressure at the inlet to the central opening in the water wheel is generally very low, and frequently close to zero. The wash liquid is drawn into the central opening by the rotating wheel. Thus, a pump that supplies the wash liquid at a pressure of about 5 psig to about 15 psig is generally adequate.

When the flow of water to water wheels in the washing machine is stopped between wash cycles, the water wheels and a centrifugal pump can continue to operate without damage to the pump. When the water flow resumes, a supply of wash liquid will be immediately available at the central opening of each water wheel, because the pump and water wheels continue to operate. While a 3 HP motor has been used to drive a centrifugal pump, less power is usually required.

The duration of time during which the water wheel is stopped is generally not critical. Ordinarily, the water wheel will be stopped for a period of time sufficient to permit the operator to unload washed objects from the machine and to load contaminated objects into the machine. The duration of time may have an effect on corrosion of the parts exposed to the wash water. For example, hot water evaporates in the compartments 18, 20, and 22 in the machine shown in FIG. 2. This results in repeated wetting and drying of the water wheel, which can result in the formation of rust and corrosion and to more rapid deterioration of the water wheel. Thus, it is desirable to use stainless steel to fabricate the parts of the apparatus that will be subjected to these conditions.

The duration of operation of the water wheel is relatively short. For example, the water wheel will typically operate for about 0.5 minute to about 20 minutes, usually about 0.75 minute to about 3 minutes, and preferably about 0.75 minute to about 1.25 minutes. In the device depicted in FIGS. 2 and 3, each of the water wheels is operated for about one minute. Thus, the worn brake shoes are subjected to two washing cycles of one minute each.

Worn brake shoes from trucks have been uniformly cleaned to bare metal when subjected to two wash cycles of one minute duration each using a 14" diameter water wheel having six flow passages, where the wheel is rotated at a speed of 1750 rpm by a 5 HP motor with water flowing into the central opening of the wheel at 50 gal/min at a temperature of about 70° F. to about 200° F. This results in the formation of approximately 10,500 dense zones per minute which impact on the object to be cleaned. The wash liquid is accelerated by the water wheel to a speed of over 6,400 feet per minute. Approximately 8.3 gallons of wash liquid flow through each flow passage per minute. It is thus apparent that the wash liquid has substantial momentum for scrubbing and cleaning the contaminated object.

The foregoing parameters can be varied if comparable energy is imparted to the wash liquid. A useful measure for ensuring that a particular water wheel design and wash liquid flow rate will produce adequate cleaning of contaminated machine parts is to determine the product obtained by multiplying the peripheral speed of the rotating wheel by the mass of wash liquid flowing through one of the flow channels during one revolution of the wheel, where peripheral speed is expressed in ft/sec, the mass of wash liquid is expressed in pounds, and the wash liquid is assumed to be at 20° C. Using the 14" diameter wheel having 6 flow passages, where the wheel is rotated at a speed of 1750 rpm and water flows into the central opening of the wheel at 50 gal/min, the product is 4.24. Increasing the horsepower to the water wheel can permit substantial increases in the mass of wash liquid that is projected onto the object to be cleaned with a resulting greater cleaning effect.

The number of flow passages in which the wash liquid is accelerated as it passes over the water wheel can be varied to suit a particular need. The number of flow passages affects the size of the arc covered by each of the dense zones of wash liquid. Specifically, the dense zones cover an arc of 180° when the water wheel has two flow passages. With four flow passages, the arc is 90°, six flow passages it is 60°, and with 12 flow passages the arc is about 30°. It is thus possible to add, remove, or simply block flow passages to control the width of the pattern emanating from the periphery of the water wheel. Adding flow passages to the wheel also concentrates the energy of the wash liquid into a smaller volume.

The number of flow passages also affects the number of dense zones of wash liquid that can be created by a water wheel rotating at a given rpm. Increasing the number of flow passages increases the number of dense zones created per unit time.

The flow passages can be evenly or unevenly spaced around the plane of the water wheel, provided that the wheel is balanced. Preferably, the flow passages are equally spaced on the plane of the wheel.

The flow passages can be straight or curvilinear, either convex or concave. Curvilinear flow channels aid in accelerating the wash liquid as it flows through the passage. The flow passages can be hooded to minimize the escape of wash liquid flowing from the central opening in the water wheel. For example, referring to FIG. 3, each of the flow passages 94 is defined by sidewalls 124 and 126 and each flow passage 94 is enclosed by a cover 128.

The flow passages can be of substantially constant cross-section or of variable cross-section throughout their length. For example, referring to FIG. 5, which shows a preferred water wheel design for use in the washing machine depicted in FIGS. 1 and 2, the flow passages 94 gradually diminish in cross-section from the central opening 90 to the periphery 92 of the water wheel 88. This results in the wash liquid being discharged from the periphery of the wheel in a more concentrated stream.

Figure 7:
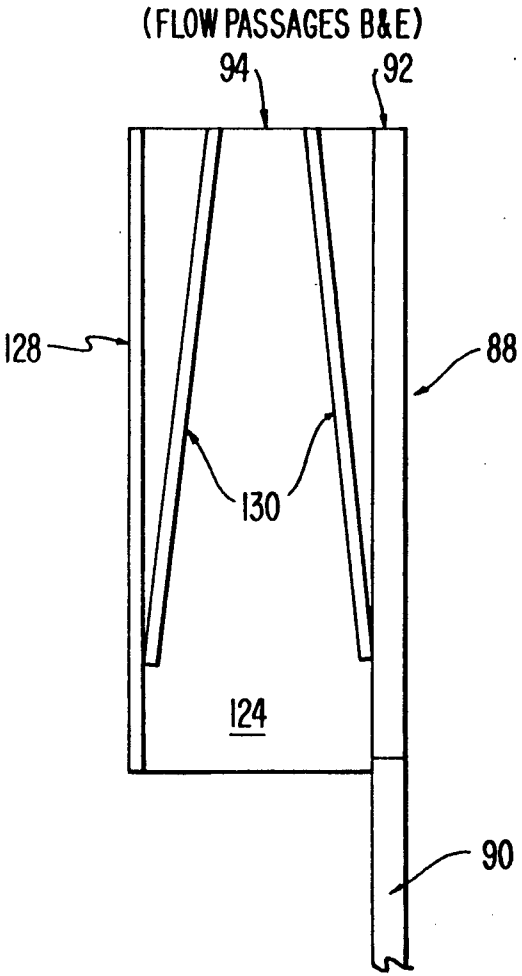
FIGS. 6, 7, and 8 show three variations of flow passages for wash liquid for use on the water wheel of FIG. 5.
Figure 8:
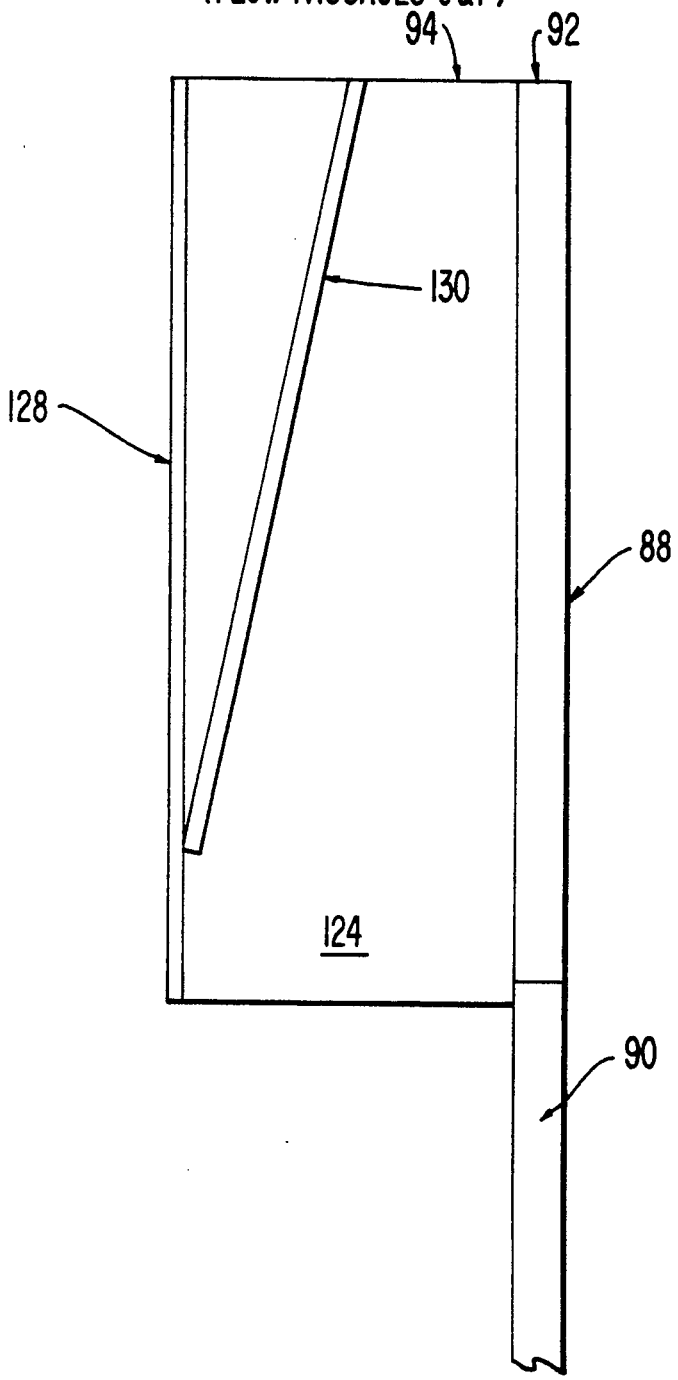

It is also possible to design the flow passages to direct the flow of wash liquid to a particular portion of the arc defined by the dense zones of wash liquid. For example, referring to FIGS. 6, 7, and 8, which show the water passages A, B, C, D, E and F on the water wheel of FIG. 5, the water passages 94 are defined by sidewalls 124, cover 128, and base plate 89. Water flows through the central opening 90 in the base plate 89 and into each of the flow passages 94. The deflector means 130 in each of the flow passages directs the wash liquid toward the periphery 92 of the water wheel where the wash liquid is discharged in different directions. Deflector means 130 in FIG. 6 would direct the wash liquid away from the viewer of the dense zone 112 in FIG. 4. Deflector means 130 in FIG. 7 would direct the wash liquid into the central portion of the dense zone 112 shown in FIG. 4. Deflector means 130 in FIG. 8 would direct the wash liquid toward the viewer of the dense zone 112 in FIG. 4.

Figure 5:
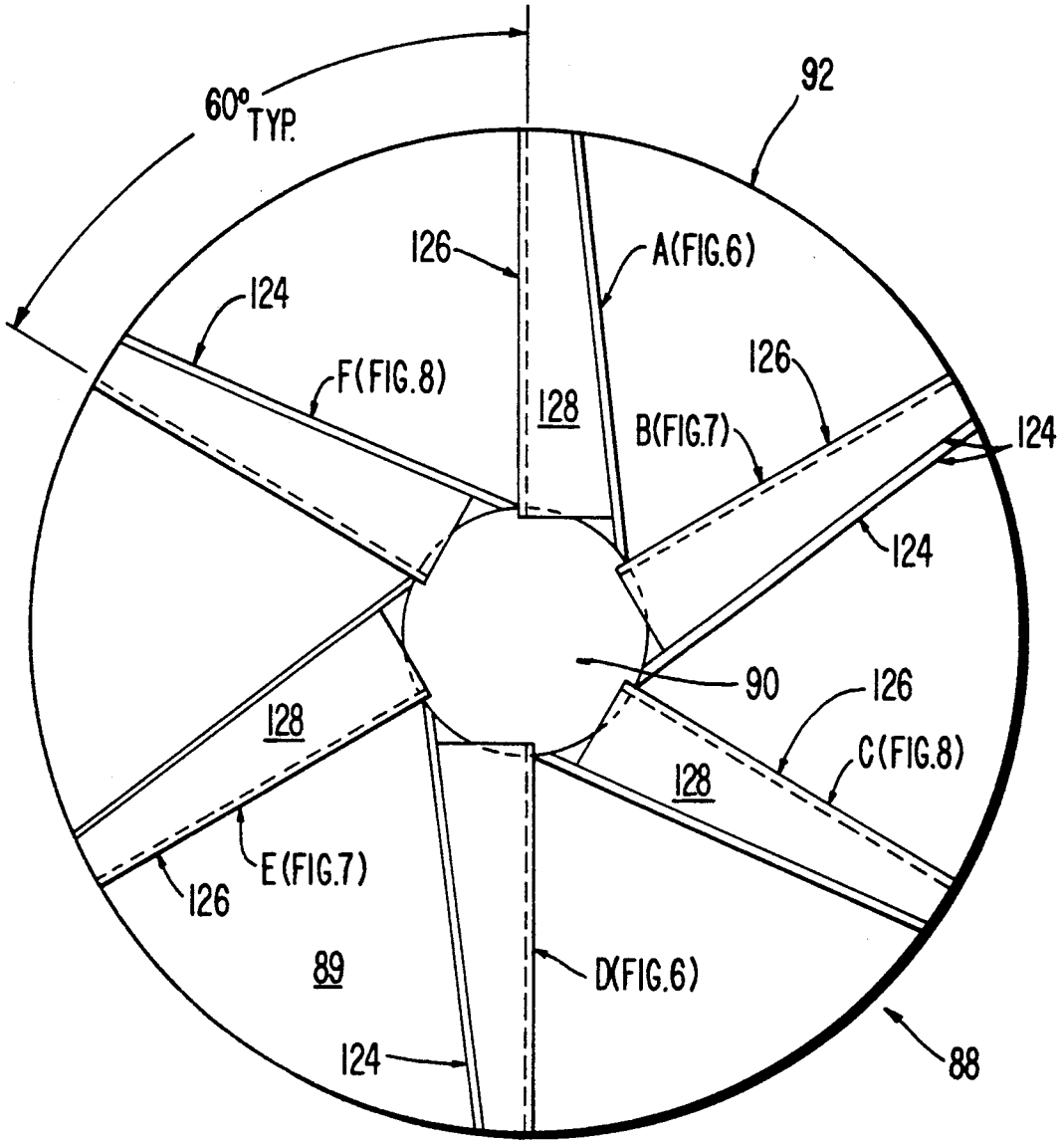
FIG. 5 is a plan view of a preferred water wheel of the invention.
Figure 6:
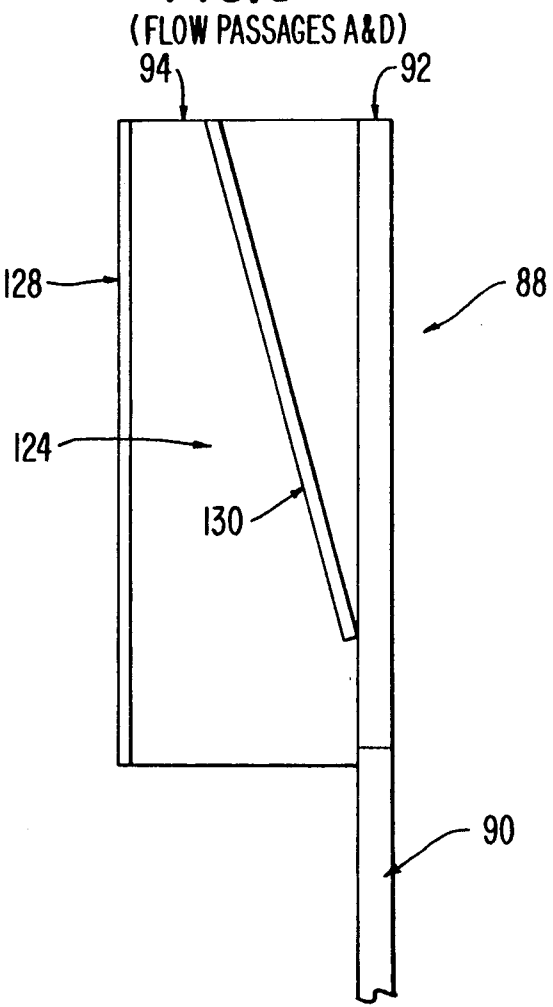
Figure 9:
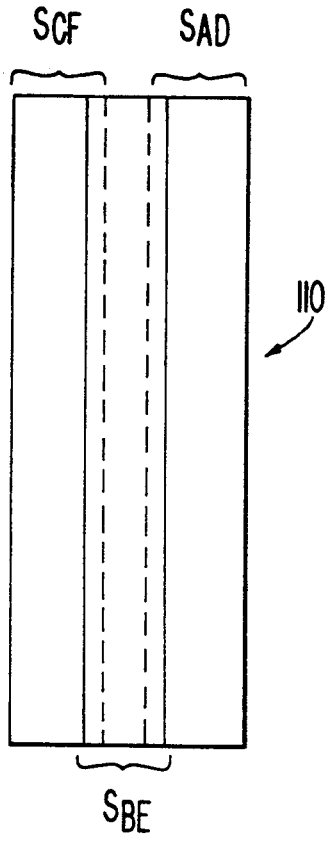
FIG. 9 shows the width of the spray pattern produced by the water wheel of FIG. 5.

More particularly, FIG. 9 shows a spray pattern 110 produced by the water wheel of FIG. 5 as viewed in a direction parallel to the radius of the wheel. Spray pattern 110 is comprised of three segments identified as $S_{AD}$, $S_{BE}$ and $S_{CF}$. The segment $S_{AD}$ is formed when the wash liquid is discharged from flow passages A and D in FIG. 5. The segment $S_{BE}$ is formed when the wash liquid exists the flow passages B and E. The wash liquid from passages C and F produce segment $S_{CF}$. The segments may overlap as shown in FIG. 9, but overlap is not required. In either event, this arrangement for concentrating and directing the streams of wash liquid flowing through the passages enhances the cleaning effect on worn brake shoes.

While three segments are depicted in FIG. 9, it will be understood that from 1 segment up to about N segments can be produced by the water wheel, where N is the number of flow passages on the water wheel.

It will be apparent that the water wheel can be fabricated by casting the water wheel in a single piece or by welding the sidewalls and covers to the water wheel to form the flow passages. The parts are usually welded when the base plate, sidewalls, and cover are fabricated from stainless steel.

The flow diverter in the central opening of the water wheel controls the passage of water from the central opening into the flow passages as previously described. The size of the opening 106 in the cylindrical portion 104 of the flow diverter 110 in FIG. 3 is varied with the number of flow passages on the water wheel. Specifically, when the water wheel contains four flow passages, the opening 106 extends over about one-quarter of the circumference of the cylindrical portion 104. For a water wheel having six flow passages, the opening is decreased to about one-sixth of the circumference of the cylindrical portion 104. The size of the opening is correspondingly reduced as the number of flow passages increases.

In addition, the location of the opening in the flow diverter affects the direction in which the dense zones are projected from the periphery of the water wheel. The center of the opening 104 in the flow diverter should be about 90° from the point where maximum force of the wash liquid is to be focused on the object being cleaned. In the device shown in FIG. 3, the flow diverter should be rotated by about 90° in a clockwise direction after it is inserted in the opening 98 so that the arrow inscribed on the base plate 102 points in the direction of the opening 86 in the water wheel cabinet 50. This will result in the dense zones of wash liquid being directed downwardly into the compartments 18, 20, and 22 during operation of the washing machine shown in FIG. 2.

The distance between the object being cleaned and the periphery of the water wheel affects the degree of cleaning. The object should not be placed so close to the periphery of the wheel that the dense zones of wash liquid are prevented from forming at a distance from the periphery of the wheel. Similarly, the objects should not be placed so far from the periphery of the wheel that the wash liquid in the dense zones does not have sufficient energy to properly clean the object. Generally, the distance between the periphery of the water wheel and the object will be about the 1 inch to about 30 inches, preferably about 6 inches to about 18 inches.

The number of water wheels in the washing machine of the invention can be varied to suit a particular application. While one or more water wheels can be employed, the use of two water wheels in the device shown in FIGS. 1 and 2 has been found to be particularly effective for cleaning worn brake shoes from trucks. In the device shown in the Figures, one of the water wheels forms downwardly directed dense zones of cleaning liquid, while the other water wheel forms upwardly directed dense zones. This provides cleaning from different directions.

The workpiece chamber can be varied to suit a particular application. The configuration of the chamber will depend upon the size, weight, shape, and number of objects to be cleaned. The workpiece chamber can be comprised of one or more compartments. It will be understood that the compartments can be passed in front of the rotating water wheels or the water wheels can be passed over or under objects in the workpiece compartment. The objects can be hung in the workpiece chamber as previously described. The hangar can be rotatable or stationary. For cleaning worn brake shoes prior to reconditioning the brake shoes, it is preferred to hang a brake shoe in the workpiece chamber and to rotate the brake shoe at about 4 rpm to about 6 rpm. The workpiece chamber can be provided with a conveyor or rotating table for moving the objects being treated. A tumbling device, such as a rotating drum or basket can also be employed. Similarly, the objects to be treated can be supported on a belt which moves and causes the objects to tumble on the belt.

The workpiece chamber can be provided with a fan or other means for drawing steam and water vapor away from the washing machine to aid operator comfort and safety. When the workpiece chamber is divided into compartments, it is preferable that each compartment be provided with a drain opening to allow spent wash liquid to flow from the compartment into the water tanks for reuse. Objects can be effectively cleaned by using several water wheels projecting wash liquid at different angles onto the objects.

While the use of a water heater has been described in connection with the preferred washing machine depicted in FIGS. 1 and 2, means for heating the washing liquid is optional. The temperature of the wash liquid depends upon the nature of the contaminants to be removed from the object being cleaned and the temperature that can be tolerated by the object. For cleaning machine parts contaminated with petroleum based deposits, the use of elevated temperatures is preferred. For example, for cleaning brake shoes contaminated with grease and oil, it is preferred to heat the water to a temperature of about 170° to about 200° F. Elevated temperatures aid in removing the petroleum based deposits, since the deposits become flowable at these temperatures. If the machine parts are not contaminated with petroleum materials, it is acceptable to employ the wash liquid at a temperature of about 70° F. or higher. At temperatures above about 200° F., it is necessary to provide for the removal of the increased amounts of water vapor formed in the workpiece chamber to safeguard the operator of the washing machine. Use of the higher temperatures can shorten the time of the washing cycle. Conversely, if the lower temperatures are employed, the wash cycle can be extended accordingly.

Tap water and pond water have been found to be effective wash liquids. It will be understood, however, that other liquids can be employed and that materials can be added to the wash liquid. For example, organic solvents can be mixed with water, although their use is not preferred for economic and environmental reasons. Similarly, small amounts of surface active agents can be employed as needed. Small amounts of solid, abrasive particles can be incorporated in the wash liquid provided that the object being cleaned is not damaged. In the preferred embodiment of the invention, the wash liquid is substantially free of organic solvents, detergents, surface active agents and added abrasive materials. The wash liquid can be recycled and reused.

If the wash liquid becomes highly contaminated, the contaminants can be concentrated by evaporating the water to produce a concentrated sludge that can be easily discarded. The evaporated water can be vented to the atmosphere and a suitable amount of make-up water can be added to the washing machine. It is thus possible to remove grease, oil, asbestos particles, dirt, and other hazardous materials from contaminated machine parts and to concentrate the contaminants in a form in which they can be safely disposed.

The apparatus of this invention is particularly well suited for cleaning automotive and truck brake shoes as previously described. The apparatus is also effective for cleaning other types of machine parts. For example, the apparatus and method can be employed for removing quench oil on heat treated items; removing oil, chips, and cuttings from items that have been machined; washing salvaged automotive engines and parts prior to resale or reuse; washing vehicle wheels and tires; and washing die oil from formed parts prior to painting.

In summary, this invention provides an apparatus for cleaning mechanical parts covered with solid dirt, grease, oil and other contaminants. Water soluble as well as water insoluble contaminants can be quickly and safely dislodged from the objects. Heavy encrustations of solid matter are quickly removed. The apparatus is of relatively simple construction, of reasonable cost, and requires relatively low maintenance during operation. Because of the cleaning effect produced by the water wheel, cleaning time is of relatively short duration. Small amounts of the wash liquid are required. In addition, water is a particularly effective wash liquid. The wash liquid can be reused, and contaminants in the liquid can be concentrated, separated, and safely discarded.

What is claimed is:

1. A washing machine for nondestructively cleaning an object, wherein the washing machine comprises:

(a) enclosure means for containing an object to be cleaned;

(b) opening means in the enclosure for introducing an object to be cleaned into the enclosure means and for removing the object from the enclosure means;

(c) a reservoir of abrasive-free wash liquid;

(d) means for projecting the abrasive-free wash liquid into the enclosure means, wherein said projecting means comprises (1) rotatable wheel means having an outer periphery and a central opening;

(2) means for feeding wash liquid at high volume and low pressure from the reservoir to the central opening of the wheel means;

(3) a plurality of flow passage means on the rotatable wheel means for delivering the wash liquid from the central opening to the periphery of the wheel means; and (4) means in the central opening of the wheel means for diverting flow of the wash liquid from the central opening into each of the flow passage means during a portion of each revolution of the wheel means; and (5) means for rotating the wheel means independently of the pressure of the wash liquid fed to the central opening, the rotating means for boosting velocity of the wash liquid between the central opening and the periphery of the wheel means to thereby discharged wash liquid from the periphery of the wheel means at high momentum in a wash pattern comprising a plurality of spaced apart, geometrically similar, discrete, arcuate, dense zones of the wash liquid to thereby produce a pulsed washing effect on the object being cleaned;

(e) means for supporting the object to be cleaned in a position to receive the liquid discharged from the wheel means before the dense zones of liquid dissipate; and (f) means for draining spent wash liquid form the enclosure means.

2. Washing machine as claimed in claim 1, including container means for receiving spent wash liquid from the enclosure and means for recycling liquid in the container means to the rotatable wheel means.

3. Washing machine as claimed in claim 2, including means for heating the wash liquid.

4. Washing machine as claimed in claim 1, including means for moving the object in the wash liquid pattern.

5. Washing machine as claimed in claim 1, wherein the enclosure is divided into separate compartments and the compartments are moved into and out of the wash liquid pattern.

6. Washing machine as claimed in claim 5, including means in each compartment for suspending an object to be cleaned in each compartment and for rotating each object in the compartment in the wash liquid pattern.

7. Washing machine as claimed in claim 1, wherein one or more of the flow passages is provided with deflector means for directing fluid emanating from the passage onto the object.

8. Washing machine as claimed in claim 1, wherein one or more of the flow passages diminish in cross-section from the central opening to the periphery of the wheel.

9. A washing machine as set forth in claim 1 wherein the abrasive-free wash liquid is water.

10. A washing system for nondestructively cleaning an object, wherein the washing system comprises:

(a) a reservoir of abrasive-free wash liquid;

(b) means for projecting the abrasive-free wash liquid onto an object to be cleaned, wherein said projecting means comprises (1) rotatable wheel means having an outer periphery an a central opening;

(2) means for feeding the abrasive-free wash liquid at high volume and low pressure from the reservoir to the central opening of the wheel means;

(3) a plurality of flow passage means on the rotatable wheel means for delivering the wash liquid from the central opening to the periphery of the wheel means;

(4) means in the central opening of the wheel means for diverting flow of the wash liquid from the central opening into each of the flow passage means during a portion of each revolution of the wheel means; and (5) means for rotating the wheel means independently of the pressure of the wash liquid fed to the central opening of the wheel means, the rotating means for boosting velocity of the wash liquid between the central opening and the periphery of the wheel means to thereby discharge wash liquid from the periphery of the wheel means at high momentum in a wash pattern comprising a plurality of spaced apart, geometrically similar, discrete, arcuate, dense zones of the wash liquid to thereby produce a pulsed washing effect on the object being cleaned;

(c) means for supporting the object to be cleaned in a position to receive the liquid discharged from the wheel means before the dense zones of liquid dissipate.

11. Washing system as claimed in claim 10, including container means for receiving spent wash liquid and means for recycling liquid in the container means to the rotatable wheel means.

12. Washing system as claimed in claim 11, including means for heating the wash liquid.

13. Washing system as claimed in claim 10, including means for moving the object in the wash liquid pattern.

14. Washing system as claimed in claim 10, including means for suspending an object to be cleaned and for rotating the object in the wash liquid pattern.

15. Washing system as claimed in claim 10, wherein one or more of the flow passages is provided with deflector means for directing fluid emanating from the passage onto the object.

16. Washing system as claimed in claim 10, wherein one or more of the flow passages diminish in cross-section from the central opening to the periphery of the wheel.

17. A washing system as set forth in claim 10 wherein the abrasive-free wash liquid is water.

18. A method for nondestructively cleaning an object wherein the method comprises:

(a) inserting an object contaminated with foreign matter into an enclosure;

(b) feeding abrasive free wash liquid at a predetermined velocity and pressure to a center of a rotatable liquid projector; and (c) rotating the projector independent of the predetermined pressure and velocity of the wash liquid supplied to the central opening to boost a velocity of the wash liquid from the predetermined velocity to a discharge velocity greater than the predetermined velocity, to project the wash liquid into the enclosure and onto the object for a time sufficient to dislodge the foreign matter and to wash the foreign matter from the object;

wherein the wash liquid is discharged from the periphery of the projector at high speed, and the wash liquid is discharged from the projector in a pattern comprising a plurality of spaced apart, geometrically similar, arcuate, dense zones of the liquid.

19. Method as claimed in claim 18, wherein the wash liquid is water having a temperature of about 70° F. to about 200° F.

20. Method as claimed in claim 19, wherein the object is rotated in the pattern of wash liquid.

21. A washing machine for nondestructively cleaning an object, wherein the washing machine comprises:

(a) enclosure means for containing an object to be cleaned;

(b) opening means in the enclosure means for introducing an object to be cleaned into the enclosure means and for removing the object form the enclosure means;

(c) a reservoir of abrasive-free wash liquid;

(d) means for projecting the abrasive-free wash liquid in the enclosure means, wherein said projecting means comprises (1) rotatable wheel means having an outer periphery and a central opening for receiving the wash liquid;

(2) a plurality of flow passage means on the rotatable wheel means for delivering the wash liquid from the central opening to the periphery of the wheel means; and (3) means in the central opening of the wheel means for diverting flow of the wash liquid from the central opening into a portion of said plurality of flow passage means as the wheel means rotates;

(e) means for feeding said wash liquid at high volume and low pressure from the reservoir to the central opening of the wheel means;

(f) means for rotating the projecting means independently of the pressure of the wash liquid fed to the central opening of the wheel means so that the wash liquid is accelerated between the central opening of the wheel means and the outer periphery of the wheel means in order to discharge the wash liquid at high momentum from the outer periphery of the wheel means in a pattern comprising a plurality of spaced apart, geometrically similar, arcuate, dense zone of wash liquid; and (g) means for supporting the object to be cleaned in a position to receive the liquid discharged from the outer periphery of the wheel means before the dense zones of liquid dissipate.

22. An washing machine as set forth in claim 21 wherein the abrasive-free wash liquid is water.

23. An apparatus for nondestructively cleaning an object, the apparatus comprising:

(a) an enclosure for containing an object to be cleaned;

(b) a reservoir of abrasive-free wash fluid;

(c) rotatable projecting means having a peripheral edge region and having a center portion flow connected to the reservoir for receiving wash liquid at a predetermined pressure; and (d) means for rotating the projecting means independently of the predetermined pressure of wash liquid received by the projecting means, the rotating means for boosting a velocity of the wash liquid between the center portion and the peripheral edge region in order to discharge the wash fluid from said peripheral edge region in a pattern comprising a plurality of spaced apart, geometrically similar, arcuate, dense zones of fluid,

24. An apparatus as set forth in claim 23 wherein the abrasive-free wash liquid is water.

* * * * *

UNITED STATES PATENT AND TRADEMARK OFFICE

CERTIFICATE OF CORRECTION

PATENT NO. : 5,259,890

DATED : November 9, 1993

INVENTOR(S) : James R. GOFF

It is certified that error appears in the above-identified patent and that said Letters Patent is hereby corrected as shown below:

Claim 1, col. 13, line 64, change "discharged" to --discharge--; and col. 14, line 7, change "form" to --from--.

Claim 10, col. 14, line 43, change "an" to --and--.

Claim 22, col. 16, line 36, change "An" to --A--.

Claim 23, col. 16, line 55, change "fluid," to --fluid.--.

Signed and Sealed this

Seventh Day of June, 1994

Bruce Lehman

*Attest:*

BRUCE LEHMAN

*Attesting Officer*

*Commissioner of Patents and Trademarks*